US005395458A

United States Patent [19]

Fuerst et al.

[11] Patent Number: 5,395,458

[45] Date of Patent: Mar. 7, 1995

[54] METHOD TO ENHANCE THE THERMOMECHANICAL PROPERTIES OF HOT-FORMED MAGNETS AND MAGNETS FORMED THEREBY

[75] Inventors: Carlton D. Fuerst, Royal Oak; Earl G. Brewer, Warren, both of Mich.

[73] Assignee: General Motors Corporation, Detroit, Mich.

[21] Appl. No.: 886,210

[22] Filed: May 21, 1992

[51] Int. Cl.[6] ..... H01F 1/02

[52] U.S. Cl. ..... 148/101; 148/104

[58] Field of Search ..... 148/101, 104; 419/12, 419/61, 68

[56] References Cited

U.S. PATENT DOCUMENTS

| | | | |
|---|---|---|---|
| 4,802,931 | 2/1989 | Croat | 148/302 |
| 4,844,754 | 7/1989 | Lee | 148/302 |
| 5,049,203 | 9/1991 | Mukai et al. | 148/101 |

OTHER PUBLICATIONS

Ben-pei Cheng et al, J. Appl. Phys., 61 (8), 15 Apr. 1987 pp. 3586-3588.

C. D. Fuerst et al, J. Appl. Phys., 66 (4), 15 Aug. 1989 pp. 1782-1788.

A. V. Andreev et al, Journal of the Less-Common Metals, 162 (1990), pp. 33-37.

Y. S. Touloukian et al, Thermophysical Properties of Matter, vol. 12, chapter entitled "Thermal Expansion . . . Alloys". 1975 pp. 3a-31a.

A. V. Andreev et al, Sov. Phys. Solid State, 27 (6), Jun. 1985 pp. 987-990.

D. Givord et al, Physica 130B, 1985, pp. 323-326.

D. Givord et al, Journal of Magnetism and Magnetic Materials, 54-57 (1986), pp. 445-449.

K. H. J. Buschow, Journal of the Less-Common Metals, 118 (1986), pp. 349-353.

K. H. J. Buschow et al, Journal of the Less-Common Metals, 135 (1987), pp. 39-46.

H. Fujii et al, Journal of Magnetism and Magnetic Materials, 70 (1987), pp. 331-333.

K. H. J. Buschow, J. of the Less-Common Metals, 144 (1988), pp. 65-69.

*Primary Examiner*—John P. Sheehan

*Attorney, Agent, or Firm*—George A. Grove

[57] ABSTRACT

In a preferred method, a magnetically hard composition is prepared by intermingling rare earth (RE) metal, transition metal (TM) and boron (B) alloy powders of the general formula RE-$(Fe_{(1-x)}Co_x)$-B. The value of x ranges from 0 to 1 and is different for each of the powders, thus providing a blend of alloy powders with diverse Curie temperature ($T_c$) and a less abrupt rate of change of thermal expansion and/or specific heat with temperature, as compared to a single alloy powder.

The magnetically hard compositions with improved thermomechanical properties are formed from two or more alloy powders. Preferably, two alloy powders are used and the value of x for the first alloy is less than about 0.1. The value of x for the second alloy is in a range of about 0.1 to about 0.6, and preferably 0.3 to 0.5.

When the intermingled alloy powders of the invention are hot pressed with or without subsequent hot working, a magnetically hard body is formed and it is characterized by a lesser rate of change of specific heat and/or thermal expansion with temperature as compared to any one of the single alloy powders similarly hot pressed or hot worked.

20 Claims, 5 Drawing Sheets

METHOD TO ENHANCE THE THERMOMECHANICAL PROPERTIES OF HOT-FORMED MAGNETS AND MAGNETS FORMED THEREBY

FIELD OF THE INVENTION

This invention relates to permanent magnets formed of rare earth-transition metal-boron (RE-TM-B) alloys. More particularly, this invention relates to such alloys having a portion of the transition metal replaced with cobalt.

BACKGROUND OF THE INVENTION

Hot-formed magnets of rare earth-iron-boron alloys are predisposed to mechanical failures such as cracks and fractures which occur during cooling or handling. Such failures reduce production capacity and increase waste material. The tendency to crack is in part intrinsic to the mechanical properties of the 2-14-1 phase present in the magnet, for example, as in $Nd_2TM_{14}B_1$ magnets. As a magnet starts to cool from a hot-worked condition, the magnet contracts at a rate determined by its single alloy composition. Each single alloy composition exhibits an abrupt change in the rate of thermal expansion or specific heat with temperatures at or near its Curie temperature. Such an abrupt change causes stresses which persist after the hot-formed magnet cools to room temperature.

SUMMARY OF THE INVENTION

In a preferred method, a crack-resistant permanent magnet is prepared using a mixture of two or more compositions of rare earth (RE) metal-transition metal (TM)-boron (B) alloy powders within the general formula RE-$(Fe_{(1-x)}Co_x)$-B. The value of x is different for each of the powders, thus providing a blend of powdered alloys with diverse Curie temperature ($T_c$) and a less abrupt rate of change of thermal expansion with temperature, as compared to a single alloy powder.

The magnetically hard compositions with improved thermomechanical properties are formed from two or more alloy powders. Each of the alloy powders comprises, on an atomic basis, 10 to 50 percent rare earth (RE) metal at least 60 percent of which is neodymium and/or praseodymium, at least one percent boron, and 50 to 90 percent transition metal (TM). Each of the powders may have some carbon with the boron. The TM consists of iron (Fe) and cobalt (Co) present in an atomic proportion of Fe and Co of $Fe_{(1-x)}Co_x$. The value of x ranges from 0 to 1, with the total of Fe and Co constituting the TM. Each alloy powder has particles with a maximum cross-dimension of about 20 to about 500 microns, desirably about 40 to about 300 microns, and preferably about 50 to about 250 microns.

Desirably, two alloy powders are used, the value of x for the first alloy is less than about 0.1 and preferably about 0. The value of x for the second alloy is in a range of about 0.1 to about 0.6 and preferably about 0.3 to about 0.5.

When the intermingled alloy powders of the invention are pressed and heated with or without subsequent hot working, a magnetically hard body is formed and it is characterized by a lesser rate of change of specific heat and/or thermal expansion with temperature as compared to any one of the single alloy powders similarly pressed and heated or hot worked.

The method is applicable to a family of RE-TM-B alloys which are further characterized by the presence or formation of a tetragonal crystal phase, illustrated by the atomic formula $RE_2TM_{14}B$. In the magnet product, the grains of this phase are small, preferably less than about 1000 nm in largest dimension. The microstructure of the magnet is also characterized by a minor portion of a grain boundary phase that is typically richer in RE content than the essential 2-14-1 phase. A preferred RE-TM-B alloy has approximately the following atomic proportions: $Nd_{13.75}TM_{80.25}B_6$.

Advantageously, the invention identifies important factors which contribute to cracking in RE-TM-B magnets and provides methods for preparing new magnets with non-uniform alloy compositions. Such new magnets exhibit a lesser rate of change of thermomechanical properties with temperatures at or near the Curie temperature ($T_c$). Accordingly, the magnets of the invention are much less prone to mechanical failure.

These and other objects, features and advantages will become apparent from the following description of the preferred embodiments, appended claims and accompanying drawings.

BRIEF DESCRIPTION OF THE DRAWINGS

FIG. 1(*a*) shows the change in fractional length and FIG. 1(*b*) shows the change in thermal expansion coefficient $\alpha$.

FIG. 3 also shows projected value of $\alpha$ for comparison.

FIG. 4(*b*) shows the first derivative of the graph of FIG. 4(*a*), defining $\Delta T_c$.

DETAILED DESCRIPTION OF THE PREFERRED EMBODIMENTS

Figure 1:
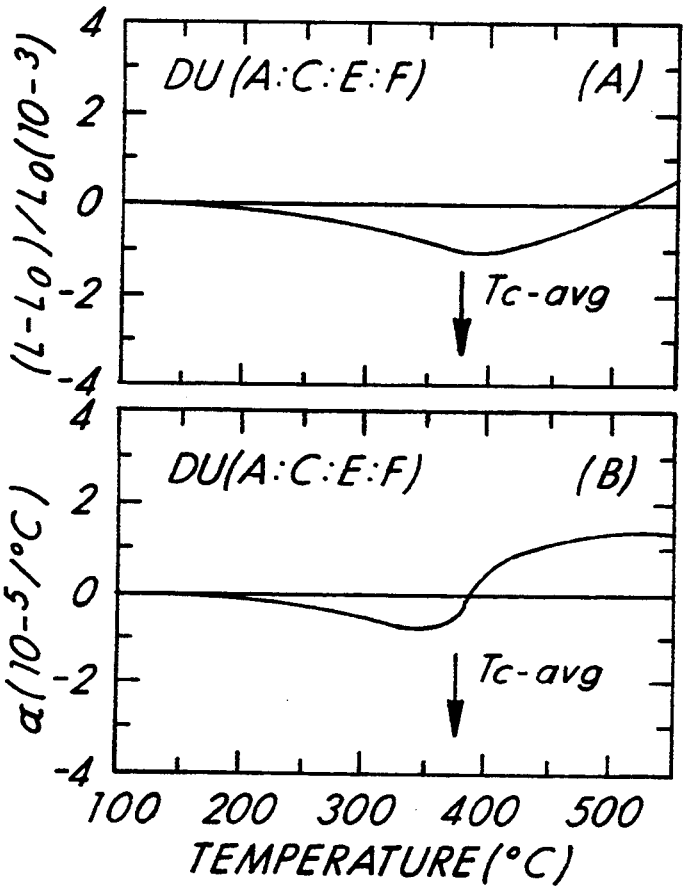
FIGS. 1(*a*) and (*b*) are graphs of thermomechanical properties of a magnet formed of mixed alloy powders versus temperature.

In a preferred embodiment, a magnetically hard composition is prepared by intermingling rare earth (RE) metal, transition metal (TM) and boron (B) alloy powders of the general formula RE-$(Fe_{(1-x)}Co_x)$-B. The value of x is different for each of the powders, thus providing a blend of alloy powders with diverse Curie temperature ($T_c$) and a less abrupt rate of change of thermal expansion with temperature, as compared to a single alloy powder.

The magnetically hard compositions of this invention were formed from two or more alloy powders. Each of the powders has three basic components: rare earth metal (RE), transition metal (TM) and boron (B). Each of the alloy powders comprises, on atomic basis, 10 to 50 percent rare earth (RE) metal at least 60 percent of which is neodymium and/or praseodymium, at least one percent boron, 50 to 90 percent transition metal (TM) taken from the group consisting of iron (Fe) and cobalt (Co) present in an atomic proportion of Fe and Co of $Fe_{(1-x)}Co_x$. A preferred RE content is within the range of 10 to 20 atomic percent. The value of x ranges from 0 to 1, that is, TM being all Fe to TM being all cobalt. Intermediate compositions between the extreme of 0 and 1 are also formed.

Desirably, two alloy powders are used, the value of x for the first alloy is less than about 0.1 and preferably about 0. The value of x for the second alloy is in a range of about 0.1 to about 0.6 and preferably about 0.3 to about 0.5.

As indicated, at least 60 atomic percent of the rare earth component is neodymium and/or praseodymium. Relatively small amounts of other rare earth elements, such as samarium, lanthanum and cerium, may be mixed with neodymium and praseodymium without substantial loss of the desirable magnetic properties. Preferably, they make up no more than about 40 atomic percent of the rare earth component. Very small amounts of other elements and impurities such as carbon, zirconium, titanium, chromium, manganese, nickel, aluminum, gallium, copper and silicon can also be tolerated in the powders. The composition contains at least 1 atomic percent boron. Preferably about 1 to about 10 atomic percent boron is used. Optionally, the composition contains a total of about 10 atomic percent of combined boron and carbon.

When the intermingled alloy powders of the invention are hot pressed with or without subsequent hot working, a magnetically hard composition is formed and it is characterized by a lesser rate of change of specific heat and/or thermal expansion with temperature as compared to any one of the single alloy powders similarly hot worked.

For purposes of illustration, the invention will be described using RE-TM-B alloys of approximately the following atomic proportions: $Nd_{13.75}TM_{80.25}B_6$. However, it is to be understood that the method is applicable to a family of RE-TM-B alloys, which are further characterized by the presence or formation of a tetragonal crystal phase, illustrated by the atomic formula $RE_2TM_{14}B_1$, as the predominant constituent of the material. Preferably, hot-worked permanent magnet products contain 90 percent by volume of this tetragonal phase.

The invention is also described using melt-spun, rapidly quenched, alloy ribbons which are ground to powder form. Alloy powders formed by other means may also be used. The preferred melt-spinning process is described in U.S. Pat. Nos. 4,844,754 and 4,802,931, issued to Lee and Croat, respectively, assigned to General Motors Corporation, and basically includes the following steps. First, an ingot of the preferred $Nd_{13.75}TM_{80.25}B_6$ alloy is prepared and then remelted in a tube (crucible or tundish) made of quartz. The molten alloy is ejected through a small orifice (0.6 mm) in the bottom of the tube at a constant rate. The orifice is located only a short distance from the perimeter of a chill 10 inch diameter wheel on which the molten metal is quenched, that is, rapidly cooled and solidified to a preferred amorphous ribbon form. The wheel is chromium-plated copper and rotates at a constant speed (30 m/s) so that the relative velocity between the ejected alloy and the chill surface is substantially constant. The terms "melt spinning" or "melt spun" as used herein refer to the process described above as well as any like process which achieves a like result.

After melt spinning, the alloy ribbon has a very fine grain size, typically less than 100 nm. The ribbon is comminuted to form particles thereof each having a maximum cross-dimension of about 20 microns to about 500 microns, desirably about 40 to about 300 microns, and preferably about 50 to about 250 microns. As used herein, maximum cross-dimension refers to the largest dimension of a particle in any one plane. Crushing with mortar and pestle is suitable for small quantities.

Ribbons designated as A, C, E and F used in Examples 1 through 3 below were obtained from the Delco Remy Division of General Motors Corporation. Ribbon C had the highest cobalt content (15.5 wt. %; x=0.22). Ribbons of Example 4 were melt spun in the laboratory to provide ribbons with even greater cobalt content (x greater than 0.22). All ribbons were comminuted to form particles smaller than the ribbons.

The RE-TM-B alloy powders are intermingled to form compositions which are consolidated or compacted to a solid magnetic body. Properties of the solid magnetic body formed from intermingled alloy powders vary depending upon the density of the powder composition.

Complete densification of melt-spun ribbons is afforded by hot pressing, preferably uniaxial hot pressing. Requisite pressures (P) and temperatures (T) depend on the starting alloy composition, but for compositions of the invention, full density is achieved by hot pressing at 700° C. to 900° C. for about one minute and at about 70 MPa pressure. A 0.5 inch diameter die was used for hot pressing in the examples below. Uniaxial hot pressing introduces only a slight crystallographic alignment of the easy c-axes which is parallel to the press direction. Such hot-pressed, fully dense powder is referred to as MQ2, or alternatively designated HP.

Much greater alignment and consequently much larger energy products can be obtained by an initial hot press followed by another in a die cavity of greater diameter. A 0.75 inch (ID) internal diameter die was used in the examples below. This second hot press in a larger die, designated die upsetting, produces bulk lateral plastic flow and an accompanying reduction in thickness. This die upsetting, also referred to as hot working, is conducted by maintaining a constant stress (pressure) on the sample. To achieve this, the applied load is increased from 1.5 to 5.0 kN and the temperature increased from 750° to 800°. The upsetting apparently involves grain boundary sliding and anisotropic grain growth. (See Lee '745 mentioned above.) An anisotropic magnet body is referred to as MQ3 or alternatively designated DU. Many of the properties of the compositions of the invention are described with reference to 55 percent die-upset (DU) magnets in an anisotropic condition. When die upsetting a 0.5 inch diameter, hot-pressed sample in an oversized 0.75 ID die, the reduced sample height approaches a maximum of 55 percent. As mentioned above, similar beneficial results are achievable by conventional powder metallurgy techniques using intermingled alloy powders.

EXAMPLE 1

Unannealed melt-spun ribbons were prepared having each of four alloy compositions designated A, C, E and F. Each of these alloys had nominally the same total rare earth (RE) concentrations (30–31 weight percent), and boron concentrations (0.9–1.0 weight percent). However, each alloy differed in cobalt level: C alloy contained the highest concentrations (15.5 weight percent), while E and F alloys contained less cobalt (2.7 weight percent and 6 weight percent), respectively, and A alloy contained no cobalt.

In atomic percentages, the ribbons were approximately 13.9 at % RE, 5.9 at % boron, and 80.2 at transition metal (TM), where TM accounts for both the iron and cobalt in the alloy [$TM=(Fe_{1-x}Co_x)$]. The atomic fractions of cobalt in the A, C, E and F alloys were $x_A=0$, $x_C=0.22$, $x_E=0.038$ and $x_F=0.083$, respectively. Atomic proportions are readily converted to weight proportions. By way of example, alloy C with x=0.22 (about 15.5 weight percent cobalt) is determined to have, based on 100 atomic units, the atomic fraction formula $Nd_{13.9}Fe_{62.6}Co_{17.6}B_{5.9}$, where Fe and Co together total 80.2 atomic units. More specifically, the conversion of atomic formula to weight proportions is as follows:

| | | | | | | | | | |
|---|---|---|---|---|---|---|---|---|---|
| 13.9 | × | atomic wt. Nd | = | 13.9 | × | 144.24 | = | 2005 g Nd |
| 5.9 | × | atomic wt. B | = | 5.9 | × | 10.81 | = | 64 g B |
| .78 × 80.2 | × | atomic wt. Fe | = | 62.6 | × | 55.85 | = | 3496 g Fe |
| .22 × 80.2 | × | atomic wt. Co | = | 17.6 | × | 58.93 | = | 1037 g Co |
| TOTAL | | | | 100.0 | | | | 6602 g total |
| | | | | Wt. Fraction | | Wt. % | | |
| | | Nd wt./total wt. | = | 2005/6602 | = | 30.5 | | |
| | | B wt./total wt. | = | 64/6602 | = | 1.0 | | |
| | | Fe wt./total wt. | = | 3496/6602 | = | 53.0 | | |
| | | Co wt./total wt. | = | 1037/6602 | = | 15.5 | | |
| TOTAL | | | | | | 100.0 | | |

The A, C, E and F ribbons were each crushed to a coarse powder less than 60 mesh (about 250 microns) and screened to remove fine particles <270 mesh (about 50 microns). Various blends or mixtures of powders were prepared and then hot pressed and die upset. Hot-pressed (HP) magnets were produced from 14 grams of crushed powder using 0.5 inch graphite dies. Larger (0.75 ID) graphite dies were used to produce 55% die-upset (DU) magnets. HP (Z) or DU (Z) refers to hot-pressed or die-upset magnets with ribbon composition Z. All magnets of mixed powders were made using equal weight percentages of different powders. For example, the combination designated A:C:E:F contained by weight, 25% powder A, 25% powder C, 25% powder E, and 25% powder F. A magnet prepared by die upset of an A:C:E:F powder blend is referred to as DU (A:C:E:F). For comparison, single powder alloys were also analyzed.

Densities were measured using the standard water displacement technique. Demagnetization curves were obtained with a Walker Model MH-50 hysteresisgraph after pre-magnetizing the sample in a 130 kOe pulsed field to ensure saturation. Curie temperatures ($T_c$) were measured on annealed powders using a differential scanning calorimeter (DSC). This data is summarized in Table I. Table I shows various properties for die-upset and hot-pressed magnets of single powders and mixed (intermingled) powders. Values in parentheses are for the hot-pressed condition. Curie temperatures ($T_c$) were measured on annealed powders. Average Curie temperatures ($T_{c\text{-}avg}$) were calculated from separate measurements on constituent powders. Remanences ($B_r$), coercivities ($H_{ci}$), energy products [$(BH)_{max}$] and densities (p) were measured on 14 gram magnets, parallel to the press direction and are in units, respectively, kG, kOe and MGOe.

TABLE I

| Alloy | $T_c$ (°C.) | $B_r$ (kG) DU | $B_r$ (kG) (HP) | $H_{ci}$ (kOe) DU | $H_{ci}$ (kOe) (HP) | $(BH)_{max}$ (MGOe) DU | $(BH)_{max}$ (MGOe) (HP) | p (g/cc) | |
|---|---|---|---|---|---|---|---|---|---|
| A | 309.6 | 11.6 | (8.5) | 9.4 | (15.7) | 29.9 | (15.5) | 7.55 | (7.58) |
| C | 474.1 | 11.5 | (8.5) | 9.6 | (17.2) | 29.8 | (15.5) | 7.71 | (7.70) |
| E | 344.2 | 12.1 | (8.3) | 13.5 | (17.9) | 33.6 | (14.8) | 7.62 | (7.58) |
| F | 379.0 | 11.7 | (8.3) | 16.5 | (20.4) | 31.6 | (14.9) | 7.55 | (7.56) |
| | $T_c$-avg (°C.) | | | | | | | | |
| A:C:E:F | 376.7 | 12.0 | (8.5) | 14.2 | (18.6) | 32.7 | (15.9) | 7.64 | (7.63) |
| A:E:F | 344.3 | 11.8 | (8.5) | 15.7 | (19.4) | 32.0 | (15.6) | 7.61 | (7.61) |
| C:E:F | 399.1 | 11.8 | (8.5) | 14.2 | (19.0) | 31.6 | (15.7) | 7.62 | (7.65) |
| A:F | 344.3 | 11.9 | (8.4) | 16.4 | (20.0) | 32.4 | (15.4) | 7.61 | (7.62) |
| E:F | 361.6 | 12.0 | (8.5) | 17.6 | (19.8) | 33.2 | (15.5) | 7.59 | (7.61) |
| A:C | 391.8 | 11.4 | (8.5) | 10.9 | (17.2) | 29.0 | (15.7) | 7.60 | (7.64) |
| C:F | 426.6 | 11.7 | (8.4) | 13.3 | (19.0) | 31.2 | (15.4) | 7.69 | (7.65) |

Thermal expansion (dilatometry) measurements were made with a Harrop Industries ThermoMechanical Analyzer (TMA). The samples were cut from hot-formed magnets, yielding cubes about 7 mm (0.3 inches) on a side and weighing almost 3 grams. Room temperature (25° C.) sample dimensions ($L_o$) were measured with a digital micrometer. Except where noted, all dilatometry measurements were made perpendicular to the press direction. The dilatometer provides a measure of the sample length L relative to the initial length at room temperature, $L_o$. The mean coefficient of thermal expansion, $\alpha$, was calculated by taking the derivative, $(L2-L1)/(T2-T1)/L_o$ or $\Delta L/\Delta T/L_o$, numerically. Polynomial least square fits have been used to eliminate noise from the data presented in this report. The sample was held in the furnace of the dilatometer by quartz tubes.

FIG. 1 represents the thermal expansion properties of the DU (A:C:E:F) magnet produced from all four powders. The thermal expansion properties of the DU (A:C:E:F) magnet were measured perpendicular to the press direction. The change in fractional length 1(*a*) and the thermal expansion coefficient 1(*b*) has a broad minimum in the range 350° C. to 400° C. Unlike the single powder magnets of FIG. 2, there was no sharp transition in $\alpha$ for the DU (A:C:E:F) magnet. Instead there was a broad minimum located near the average of all four Curie temperatures ($T_{c\text{-}aver}$) indicated by the arrow. By combining the four powders, each with a distinct $T_c$, the sharp transition in $\alpha$ which occurs near $T_c$ was smoothed out as compared to any die-upset magnet produced from a single powder. This was clearly seen by comparing FIGS. 1(*b*) and 2. It is precisely this broadening of the transition that may lead to lower residual stresses. Although the transition was broader, there remained a clear demarcation between contraction ($\alpha<0$) at lower temperatures and expansion ($\alpha>0$) at higher temperatures. In fact, despite the radical change in the sharpness (rate of change) of the transition, it has retained its proximity to the Curie temperature, in this case, the average Curie temperature of the constituents ($T_{c\text{-}avg}$).

Figure 2:
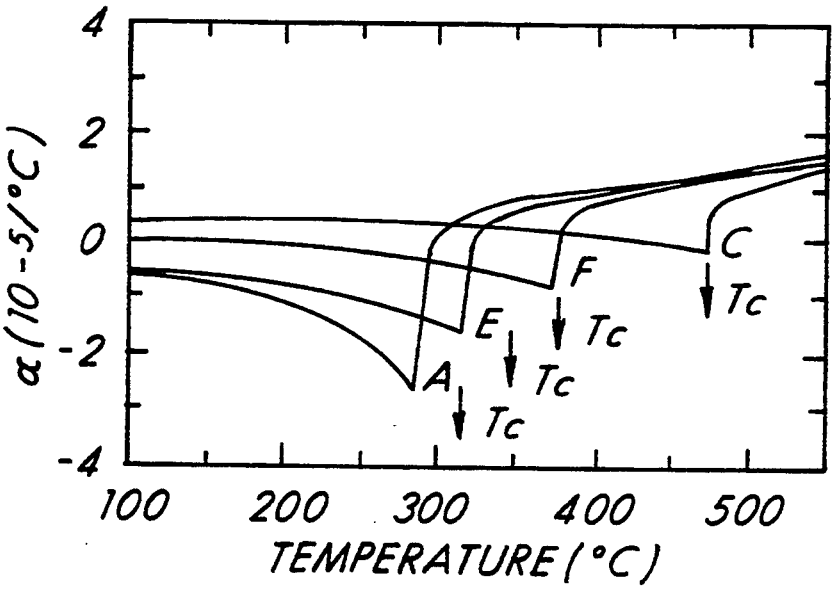
FIG. 2 a graph of $\alpha$ versus temperature for various comparative magnets each formed from a single alloy powder.
Figure 3:
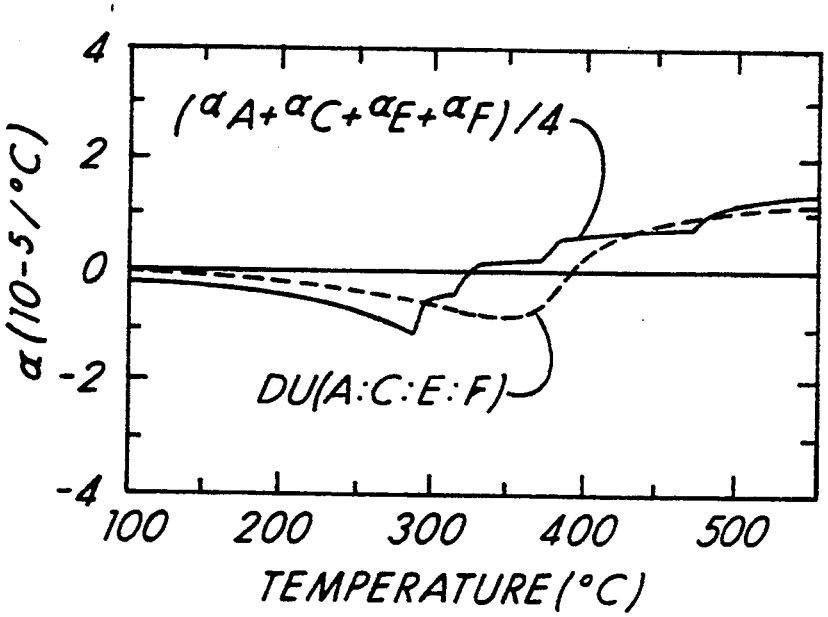
FIG. 3 is a graph of $\alpha$ versus temperature measured for a mixed alloy powder magnet.

The solid line in FIG. 3 is a numerical average of the thermal expansion coefficients ($\alpha_Z$) for each DU (Z) magnet where Z=A, C, E and F (FIG. 2). The dashed line represents the $\alpha$ measured perpendicular to the press direction on a die-upset magnet DU (Z) made from a mixture of equal weight fractions of the production powders A, C, E and F (X=A:C:E:F). The thermal expansion properties of the mixed powder magnet, DU (A:C:E:F), were not a simple average of the properties of the single powder magnets. The dashed line is identical to the data in FIG. 1(*b*).

One might have expected that mixing the powders would produce a result more like the solid line in FIG. 3, which was calculated by averaging the $\alpha$ for each single powder magnet in FIG. 2. Averaging reduces the contribution from each powder, but four transitions are still evident in the curve. The actual measured temperature dependence of $\alpha$ for DU (A:C:E:F) is provided in FIG. 3 for contrast (dashed line). Instead of approximating an average of the thermal expansion properties of the single powder magnets, the DU (A:C:E:F) magnet behaved more like an average of the composition of all four powders. Thus, the mixed powder magnets (DU (A:C:E:F)) exhibit surprising thermomechanical properties which are not simple averages of the component powders and are not the same as a homogenized powder of an A:C:E:F composition.

Combinations of two and three powders having high, middle and low Curie temperatures ($T_c$) were prepared. The temperature dependence of thermal expansion coefficients ($\alpha$) was measured perpendicular to the press direction. The presence of C powder was found to be important as it produced a smoother temperature dependence of $\alpha$ for DU (C:E:F), as compared to a sharper transition of DU (A:E:F).

The value of forming a mixture comprising alloy powder C was confirmed by studying the properties of magnets made by mixing two powders, namely, A:C, A:F, C:F and E:F. The thermal expansion of DU (A:C) and DU (C:F) was much smoother than DU (A:F) and DU (E:F). Despite the nearly 200 degrees (°C) separating the Curie temperatures of A and C powders, the thermal expansion of transitions near either powder's original $T_c$. This anomaly in the DU(A:C) magnet was centered near the average Curie temperature and was without any evidence is further evidence that diffusion across particle boundaries (regions) during hot forming tends to homogenize the magnet.

EXAMPLE 2

In this example, the procedure of Example 1 was followed to form die-upset magnets from alloy powders, except that only A and C alloy powders were mixed in various weight fractions. As before, the A alloy powder contained no cobalt (i.e. X=0), that is, essentially no cobalt was detectable. In the C powder, x was equal to 0.22, $Nd_{13.7}(Fe_{.78}Co_{.22})_{80.25}B_6$.

Magnets were formed by DU and HP as described above by mixing various weight fractions of A alloy powder (1-w) and C alloy powders (w). In addition to the two end-point compositions, w=0 and w=1, seven different mixtures of A and C alloy powders were used to produce die-upset magnets.

In Table II, properties are presented for different weight fractions of A (1-w, $x_A=0$) and C (w, $x_C=0.22$) alloys. The atomic fraction of cobalt atoms relative to total transition metal atoms (iron and cobalt) is indicated by $x_{avg}$. $T_{min}$ is defined by the minimum on the DSC measurement. Other properties are as previously indicated for Table I.

TABLE II

| | | | | | $B_r$ | | $H_{ci}$ | | $(BH)_{max}$ | |
|---|---|---|---|---|---|---|---|---|---|---|
| w | $x_{avg}$ | $T_{min}$ | $\Delta T_c$ | p | DU | (HP) | DU | (HP) | DU | (HP) |
| 0.00 | 0.00 | 315.4 | 6 | 7.59 | 12.2 | (8.5) | 8.2 | (15.8) | 33 | (16) |
| 0.10 | 0.02 | 325.4 | 20 | 7.60 | 12.0 | (8.5) | 10.8 | (17.1) | 33 | (16) |
| 0.25 | 0.06 | 342.5 | 45 | 7.62 | 12.0 | (8.5) | 10.8 | (17.3) | 33 | (15) |
| 0.40 | 0.09 | 364.6 | 54 | 7.58 | 11.8 | (8.5) | 10.5 | (17.0) | 31 | (15) |
| 0.50 | 0.11 | 386.7 | 52 | 7.64 | 11.4 | (8.6) | 10.9 | (16.3) | 29 | (16) |
| 0.60 | 0.13 | 394.2 | 56 | 7.60 | 11.7 | (8.5) | 8.8 | (17.1) | 31 | (15) |
| 0.75 | 0.17 | 427.1 | 54 | 7.61 | 11.6 | (8.6) | 9.0 | (17.5) | 30 | (16) |
| 0.90 | 0.20 | 455.8 | 34 | 7.64 | 11.5 | (8.4) | 9.2 | (17.1) | 30 | (15) |
| 1.00 | 0.22 | 484.2 | 11 | 7.72 | 12.6 | (8.5) | 11.0 | (17.2) | 30 | (16) |

Material and magnetic properties of magnets produced by combining different weight fractions of A-alloy ($x_A = 0$), (1 − w), and C-alloy ($x_C = 0.22$), (w) ribbons.

Instead of thermal expansion measurements, Differential Scanning Calorimetry (DSC) was used to characterize the transition of thermomechanical properties at $T_c$ because DSC measurements were faster to perform and more easily reproduced than thermal expansion measurements. Smaller samples for thermal analysis were sliced from the die-upset magnet using a high speed diamond saw. The samples were approximately 250–300 mg and $5\times5\times3$ $mm^3$ rectilinear. The Differential Scanning Calorimeter (DSC) used was a Perkin-Elmer model DSC-System 7. Measurements were made with a ramp rate of 25 degrees per minute in a 25 ml per minute argon purge gas flow. The DSC data has been normalized for each sample mass and the overall slope has been adjusted to simplify the figures. A solid piece of nickel metal, similar in mass and size to the die-upset samples, was used to calibrate the DSC measurement.

Figure 4:
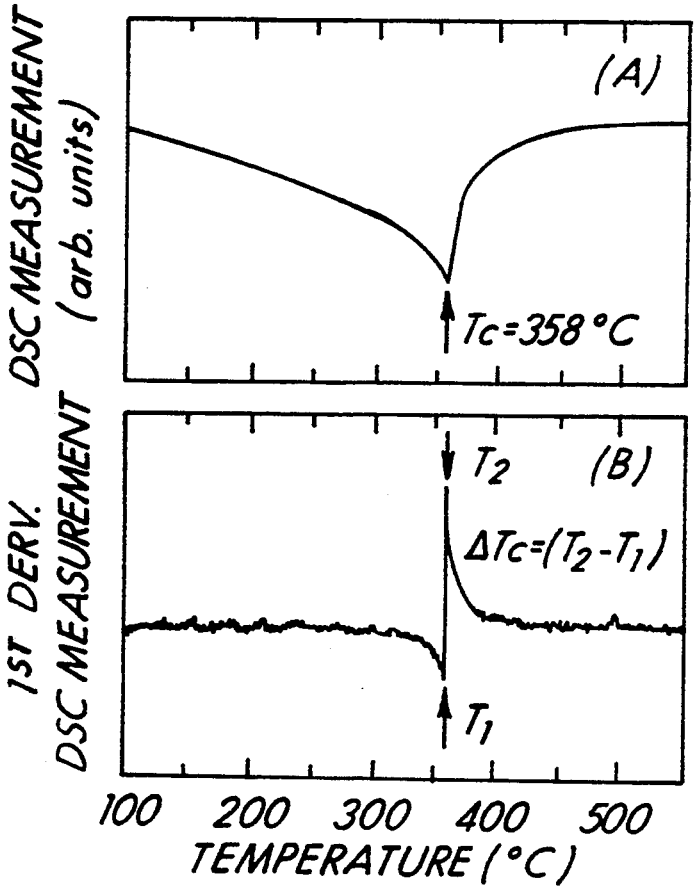
FIG. 4(*a*) is a graph of Differential Scanning Calorimeter (DSC) versus temperature for a standard metal used for calibration.

The Curie temperature was determined to occur at the minimum in the curve, indicated by the arrow in FIG. 4(*a*), which for elemental nickel is reported to be 358° C. A measure of the width of the transition at $T_c$ was defined. The transition width, $\Delta T_c$, is defined as the temperature range between maximal negative slope prior to $T_c$ and maximal positive slope after $T_c$. This can be more easily seen using the derivative of FIG. 4(*a*). In FIG. 4(*b*), the onset of $T_c$ appears as a minimum, indicated by an arrow labeled $T_1$; the other end of the range appears as a maximum and is marked by an arrow labeled $T_2$. The transition width ($\Delta T_c$) can then be defined as the difference $T_2-T_1$.

Figure 5:
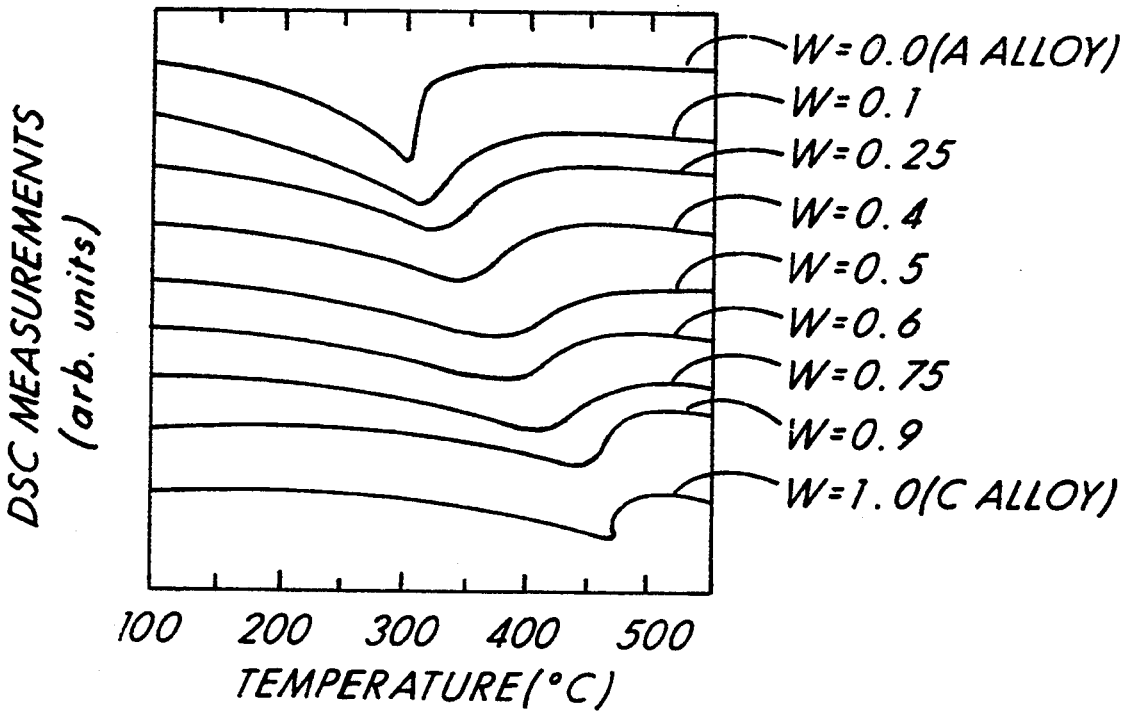
FIG. 5, 7, 8 and 10 are graphs of DSC measurements versus temperature for various alloy magnets.
Figure 6:
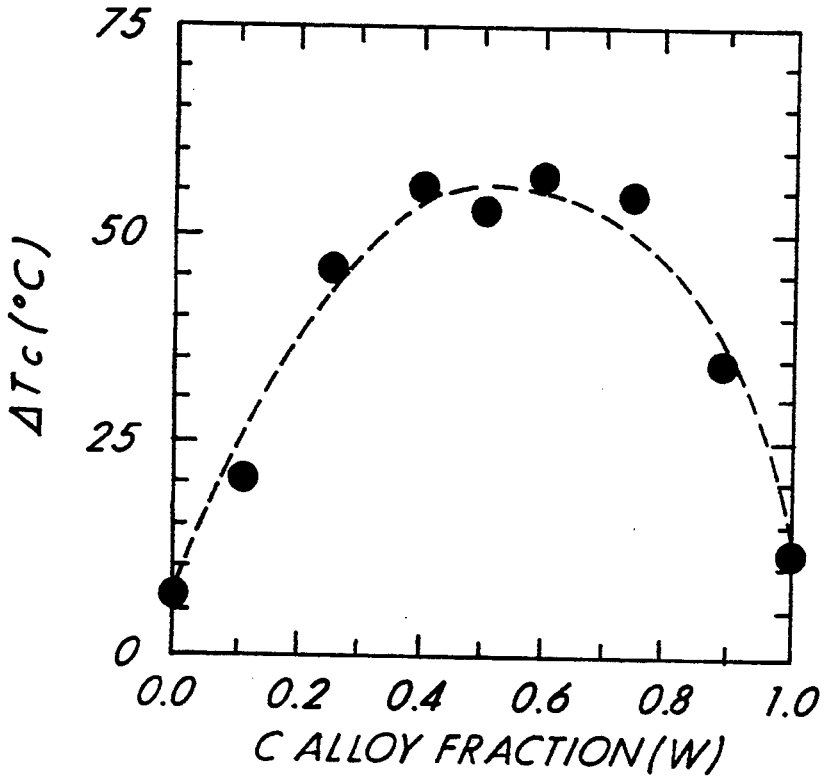
FIG. 6 is a graph of $\Delta T_c$ for various alloy magnets.

The DSC curves for intermediate compositions in FIG. 5 are clearly smoother than for A or C single alloy powders. The transition widths ($\Delta T_c$) observed in FIG. 6 are greatest in the region of about equivalent weight fractions of powders, that is, w=0.4 to 0.6.

EXAMPLE 3

Figure 7:
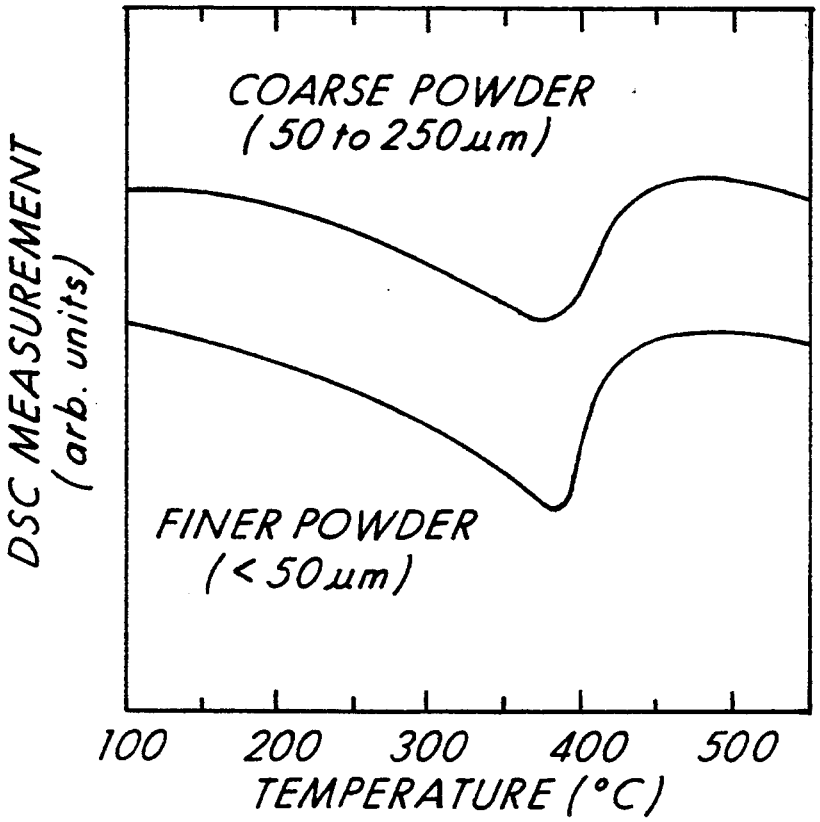

Using the method of Example 2, we made a die-upset magnet from equal amounts of A and C alloy powders (w=0.5), using powders specifically ground to less than 325 mesh (<about 50 μm), which is much finer than powders (about 50 to about 250 μm) of other examples. The DSC measurement revealed a $T_c$ transition that was nearly twice as sharp ($\Delta T_c$=32°), as observed for the magnet made from coarser powders ($\Delta T_c$=52°). DSC $T_c$ of fine powders was narrow. DSC $T_c$ of coarse powders was broader. Controlling the degree of homogeneity through particle size can therefore be another way of affecting the width of $T_{c\text{-}avg}$; coarse powders produce a less homogenous magnet and a broader transition (FIG. 7).

Because Examples 1, 2 and 3 used available Delco Remy production powders, the range of cobalt concentrations was limited. In Example 4, hot-worked magnets were prepared using ribbons melt spun in the laboratory. The melt-spun ribbons included ribbons where as much as half of the iron had been replaced by cobalt. That is, x=0.5. The Delco Remy ribbon with the highest cobalt content (ribbon C) had 15.5 weight percent cobalt with x=0.22.

EXAMPLE 4

Ribbon alloys were prepared from high purity elemental ingredients, yielding ingots with compositions of $Nd_{13.75}TM_{80.25}B_6$ (atomic percent), where the atomic fractions of iron and cobalt were as before: $TM=(Fe_{1-x}Co_x)$. Each ribbon alloy (R) had a unique cobalt portion (x).

Individual ingots were melt spun using procedures described earlier at a wheel surface speed of 30 m/s.

The ribbons were crushed to a coarse powder, particles less than 60 mesh (<about 250 μm), and screened with a 270 mesh sieve to remove fine particles (<about 45 to about 55 μm). Hot-pressed (HP) and die-upset (DU) magnets, as described above, were produced from crushed powder using, respectively, 0.5 inch and 0.75 inch die bores to produce about 55% die-upset (DU) magnets.

The composition of the magnets was determined by mixing the appropriate weight fractions of two ribbon powders, designated $R_0$ and $R_1$. The weight fraction of $R_1$ ribbons in each magnet was w, and the remainder (1-w) was $R_0$ ribbons. $R_0$ ribbons were chosen to be essentially cobalt-free, with $x_0$ less than 0.1 and about equal to zero, while the concentration of cobalt in $R_1$ ribbons ranged from about $x_1=0$ to about $x_1=0.5$. In addition to the end-point composition $x_1=0$, nine magnets were made by combining equal weights (w=0.5) of $R_0$ ($x_0$ about equal to zero) ribbons and different $R_1$ ($x_1$ not equal to zero) powders.

The magnets were analyzed by Differential Scanning Calorimetry (DSC) techniques and thermal analysis procedures described earlier.

Table III shows material and magnetic properties of magnets produced by combining equal weights of $R_0$ alloy ($x_0$=0) and $R_1$ alloy ($x_1$ up to 0.5) ribbons. The atomic fraction of cobalt atoms in $R_1$ ribbons, relative to total transition metal atoms (iron and cobalt) is as indicated by $x_1$, and $x_{avg}$ indicates the average cobalt concentration in the magnet. $T_{min}$ is defined by the minimum on the DSC measurement. Other properties are as previously indicated for Tables I and II.

TABLE III

| | | | | | $B_r$ | | $H_{ci}$ | | $(BH)_{max}$ | |
|---|---|---|---|---|---|---|---|---|---|---|
| $x_1$ | $x_{avg}$ | $T_{min}$ | $\Delta T_c$ | p | DU | (HP) | DU | (HP) | DU | (HP) |
| 0.00 | 0.000 | 311.8 | 7 | 7.51 | 12.5 | (8.6) | 9.3 | (14.0) | 36 | (16) |
| 0.10 | 0.050 | 344.2 | 19 | 7.58 | 12.2 | (8.7) | 10.2 | (17.9) | 34 | (16) |
| 0.15 | 0.075 | 363.6 | 30 | 7.64 | 12.5 | (8.8) | 7.8 | (17.7) | 34 | (16) |
| 0.20 | 0.100 | 377.9 | 48 | 7.59 | 12.5 | (8.7) | 7.2 | (17.5) | 34 | (16) |
| 0.25 | 0.125 | 392.8 | 57 | 7.60 | 12.2 | (8.6) | 7.5 | (17.4) | 32 | (16) |
| 0.30 | 0.150 | 413.0 | 70 | 7.64 | 12.2 | (8.6) | 8.9 | (16.6) | 33 | (16) |
| 0.35 | 0.175 | 422.7 | 83 | 7.64 | 12.3 | (8.5) | 9.9 | (15.4) | 34 | (15) |
| 0.40 | 0.200 | 434.8 | 100 | 7.64 | 12.0 | (8.4) | 8.5 | (13.1) | 32 | (15) |
| 0.45 | 0.225 | 449.8 | 104 | 7.70 | 11.3 | (8.2) | 7.7 | (9.5) | 26 | (13) |
| 0.50 | 0.250 | 467.2 | 112 | 7.64 | 11.0 | (8.1) | 8.3 | (8.9) | 24 | (13) |

Material and magnetic properties of magnets produced by combining equal weights of $R_0$ alloy ($x_0$ = 0), and $R_1$ alloy ($x_1$ up to 0.5) ribbons.

Figure 8:
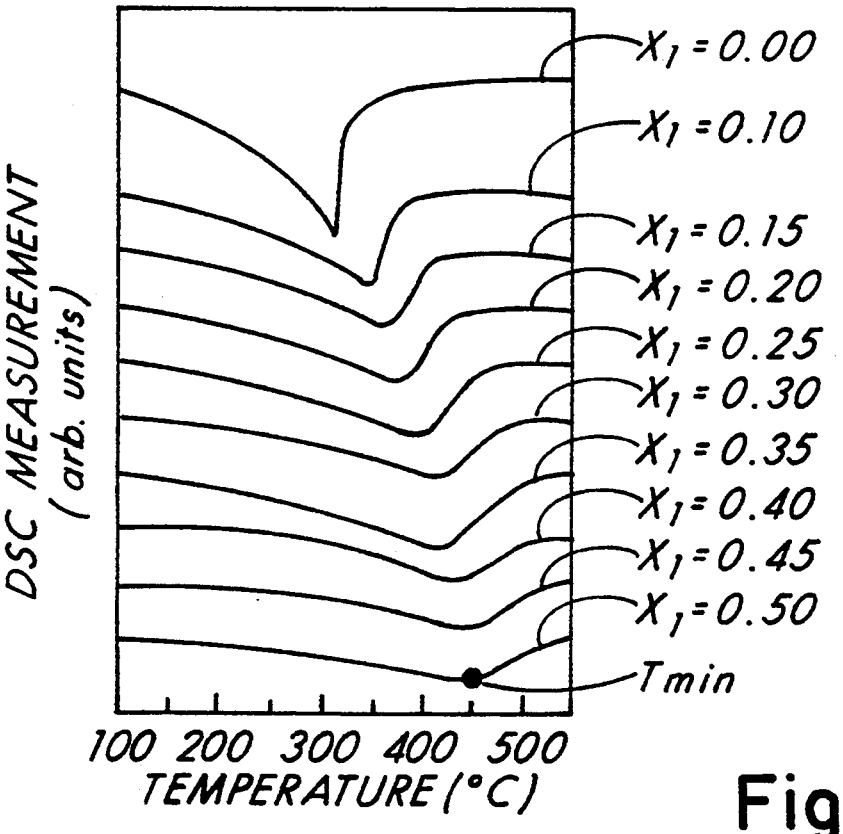
Figure 9:
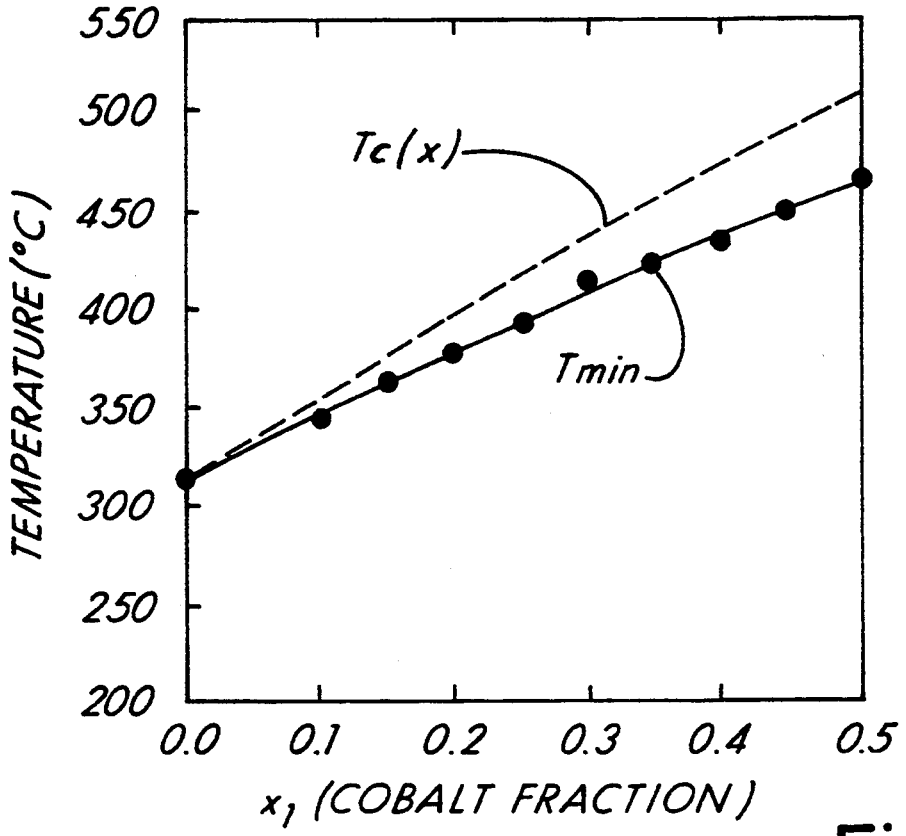
FIG. 9 is a graph showing the cobalt dependence of $T_c$ and the minimum temperature ($T_{min}$) observed for each curve of FIG. 8.

In FIG. 8, it is apparent that both the temperature at the minimum of the curves ($T_{min}$) and the width of the transition ($\Delta T_c$) increase with increasing cobalt ($x_1$). $T_{min}$ was measured at the minimum of the anomaly. The composition dependence of $T_c$ was determined using an equation developed for single phase $Nd_2(Fe_{1-x}Co_x)_{14}B$ powders: $T_c(x)=312.5+905.6\times-500.3\times^2$ to the $T_{min}$ of FIG. 8, using the average cobalt concentration ($x_{avg}$) in the magnet. The result is shown in FIG. 9. For these magnets $x_{avg}$ is half of $x_1$. The similarity of $T_{min}$ and $T_c(x)$ is evidence of the inter-ribbon diffusion during hot working.

Figure 10:
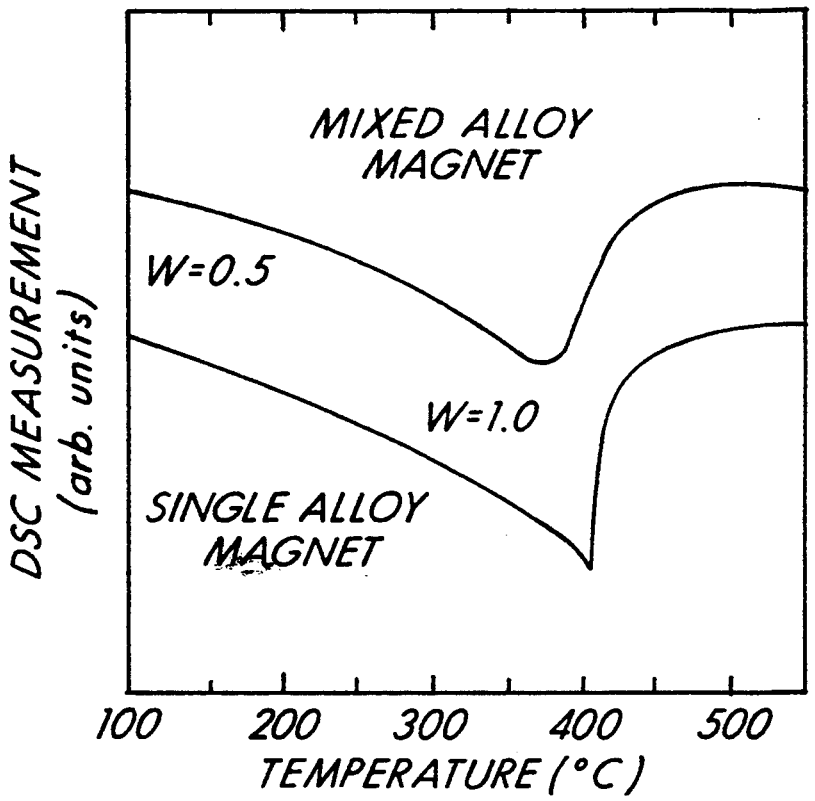

The curves in FIG. 8 demonstrate the two effects of adding cobalt-containing ribbons to the magnet: raising the average Curie temperature and increasing the width of the transition ($\Delta T_c$). These features can be separated by comparing a mixed powder magnet and a single powder magnet with comparable Curie temperatures. For example, the mixed powder magnet (w=0.5) With X=0.20 in FIG. 8, which has an average cobalt concentration of $x_{avg}$=0.10, could be compared to a single powder magnet (w=1) with the same cobalt concentration, $x_1=0.10$ (FIG. 10). The minimum points ($T_{min}$) of each curve in FIG. 10 are nearly the same, yet the curve of the mixed powder magnet indicates the smoother, less abrupt transition characteristic of its inhomogeneity. This is evidence that the addition of cobalt alone is not sufficient to increase $\Delta T_c$; broadening requires the mixing of ribbons of different compositions.

The benefit of using a high cobalt content powder (i.e. x=0.4), as compared to alloy C (x=0.22), is clearly seen by comparing Tables II and III and the figures. For example, in Table II at $x_{avg}=0.2$, *$T_c$ is 34° C., whereas in Table III at $x_{avg}=0.2$, $\Delta T_c$ is 100° C. The wider $\Delta T_c$ correspondingly produces a less sharp (less rate of change) in transition of thermomechanical properties for the powder designated as $x_1=0.4$ ($x_{avg}=0.2$) in FIG. 8, as compared to the powder labelled w=0.9 ($x_{avg}=0.2$) in FIG. 5.

It should be noted that the transition width ($\Delta T_c$) measured from the curves in FIG. 9 increased linearly with increasing $x_1$. A least square fit to the data yields a fairly steep slope; $\Delta T_c$ increases 23° for each 0.1 increment in $x_1$.

It is reasonable to expect that $\Delta T_c$ will continue to increase for even greater values of $x_1$, but ultimately the permanent magnetic properties will set an upper limit on the useful range. For the $x_1=0.45$ and $x_1=0.50$ magnets, remanence decreased about 10% compared to lower $x_1$ values (Table III). This trend is likely to continue for higher values of $x_1$. In particular, remanence will decrease rapidly for average cobalt concentrations above $x_{avg}=0.30$ ($x_1=0.60$). For $x_{avg}>0.50$ ($x_1$ about 1.0) alignment during die upsetting will be greatly reduced.

Although not wishing to be held to any particular theory, the advantages of mixed alloy powders may arise from incomplete or partial homogenization across particle boundaries or regions. Each particle has an alloy composition determined by its parent ingot and a corresponding sharp transition at $T_c$. Particles of a single alloy exhibit sharp transition as long as they are mechanically and chemically independent of particles of another alloy. Once particles of two or more alloys are intermingled and heat treated (i.e. hot-pressed or pressed at room temperature and sintered) to a solid body, some degree of homogenization occurs. Homogenization from one region to another increases with hot working (die upset). Even after hot working, complete homogenization is not reached and separate regions (particles) are still distinguishable, as outlined by oxides and impurities on the boundaries between particles. The homogenization, preferably incomplete, occurs by diffusion of elements, particularly cobalt, across regions or particle boundaries.

Diffusion would tend to homogenize the particles matrix, producing a magnet with a Curie temperature near the average Curie temperature of the ingredients ($T_{c\text{-}avg}$). If the homogenization or blending were complete, $\alpha$ of the mixed alloy powder magnet would have a sharp transition at $T_{c\text{-}avg}$. Since the transition was broad, it would be reasonable to conclude that the homogenization was incomplete. This would imply a magnet composed of small regions, or even grains, each with $T_c$ slightly different from neighboring regions. The differences between regions could be responsible for broadening the thermal expansion transition.

In summary, it has been found that broadening of the magnetic transition at $T_c$ is determined by composition variations within the mixed powder magnet. To maximize $\Delta T_c$, nearly equal proportions of two alloy powders (w=0.5) should be used; the ribbon powders should be as coarse as possible; and the difference in $T_c$ between the source ribbons should be maximal. The latter requirement encourages combining powdered alloy ribbons with little or no cobalt (low $T_c$) and powdered alloy ribbons with high cobalt levels (high $T_c$). There are practical limits to the use of cobalt, such as pricing and availability, but cobalt concentration will also be limited by the quality of permanent magnetic properties.

While this invention has been described in terms of certain embodiments thereof, it is not intended that it be limited to the above description, but rather only to the extent set forth in the following claims.

The embodiments of the invention in which an exclusive property or privilege is claimed are defined as follows:

1. In a process for preparing a permanent magnet by hot pressing particles of a rare earth metal-transition metal-boron alloy into a fully densified body consisting essentially of grains of the tetragonal crystal phase $RE_2TM_{14}B_1$ with a grain boundary phase, the improvement comprising:

hot pressing, at an elevated temperature and pressure, intermingled first and second groups of particles, each of the groups having nominally the same amounts of rare earth (RE) metal and a composition comprising, on an atomic basis, 10 to 50 percent of the rare earth (RE) metal which is at least in part selected from the group consisting of neodymium, praseodymium and mixtures thereof, at least one percent boron, and 50 to 90 percent transition metal (TM) selected from the group consisting essentially of iron (Fe), cobalt (Co) and mixtures thereof, in an atomic proportion of Fe and Co of $Fe_{(1-x)}Co_x$, where the value of x for the first group of particles is less than about 0.1 and the value of x for the second group of particles is in a range of about 0.3 to about 0.5, the elevated temperature and pressure sufficient to consolidate the particles into a fully densified body having a lesser rate of change of specific heat and/or thermal expansion with temperature as compared to such rate of change for a similarly densified body of either one of the first and second groups of the particles.

2. A process according to claim 1 wherein the first and second groups of particles are, respectively, formed by quenching a molten alloy precursor in a non-oxidizing environment at a rate sufficient to form ribbons that are amorphous or of very fine crystal grained microstructures, and then comminuting the ribbons to form the particles each having a maximum cross-dimension of about 20 microns to about 500 microns.

3. A process according to claim 2 wherein the maximum cross-dimension is about 50 to about 300 microns.

4. A process according to claim 1 wherein the first and second groups of particles are intermingled in a proportion based on 100 parts by weight of about 40 to about 60 parts of the first group of particles and the balance the second group of particles.

5. A process according to claim 1 wherein the first and second particle groups are intermingled in about equivalent parts by weight.

6. A process according to claim 1 wherein the first and second groups of particles each comprise 10 to 20 atomic percent rare earth (RE) metal, up to about 10 atomic percent boron or a combination of boron and carbon, and the balance transition metal (TM).

7. In a process for preparing an anisotropic permanent magnet by hot pressing and hot working particles of a rare earth metal-transition metal-boron alloy into a fully densified body having aligned fine crystal grains of the tetragonal crystal phase $RE_2TM_{14}B_1$, and an intergranular minor phase, the improvement comprising:

hot pressing, at an elevated temperature and pressure, intermingled first and second groups of particles, each of the groups having nominally the same amount of RE rare earth metal and a composition comprising, on an atomic basis, 10 to 50 percent rare earth (RE) metal which is at least in part selected from the group consisting of neodymium, praseodymium and mixtures thereof, at least one percent boron, and 50 to 90 percent transition metal (TM) selected from the group consisting essentially of iron (Fe), cobalt (Co) and mixtures thereof, in an atomic proportion of Fe and Co of $Fe_{(1-x)}Co_x$, where the value of x for the first group of particles is less than about 0.1 and the value of x for the second group of particles is in a range of about 0.3 to about 0.5; the elevated temperature and pressure sufficient to consolidate the particles into a fully densified body; and further hot working the body at a pressure applied in the same direction as the hot pressing and at an elevated temperature to produce the body having aligned fine crystal grains, anisotropic permanent magnetic properties and having a lesser rate of change of specific heat and/or thermal expansion with temperatures as compared to such rate of change for a similarly densified, hot-worked anisotropic body of either one of first and second groups of the particles.

8. A process according to claim 7 wherein the first and second groups of particles are, respectively, formed by quenching a molten alloy precursor in a non-oxidizing environment at a rate sufficient to form ribbons that are amorphous or of very fine crystal grained microstructures, and then comminuting the ribbons to form the particles each having a maximum cross-dimension of about 20 microns to about 500 microns.

9. A process according to claim 8 wherein the maximum cross-dimension is about 50 to about 300 microns.

10. A process according to claim 7 wherein the first and second groups of particles are intermingled in a proportion based on 100 parts by weight of about 40 to about 60 parts of the first group of particles and the balance the second group of particles.

11. A process according to claim 7 wherein the first and second particle groups are intermingled in about equivalent parts by weight.

12. A process according to claim 7 wherein the first and second groups of particles each comprise 10 to 20 atomic percent rare earth (RE) metal, up to about 10 atomic percent boron or a combination of boron and carbon, and the balance transition metal (TM).

13. In a process for preparing a permanent magnet by pressing and heating particles of a rare earth metal-transition metal-boron alloy into a fully densified body having grains of the tetragonal crystal phase $RE_2TM_{14}B_1$, the improvement comprising:

pressing and heating, at an elevated temperature and pressure, more than two intermingled groups of particles, each one of the groups of particles having nominally the same amounts of rare earth (RE) metal and comprising on an atomic basis, 10 to 50 percent of the rare earth (RE) metal which is at least in part selected from the group consisting of neodymium, praseodymium and mixtures thereof, at least one percent boron, and 50 to 90 percent transition metal (TM) selected from the group consisting essentially of iron (Fe), cobalt (Co) and mixtures thereof, in an atomic proportion of Fe and Co of $Fe_{(1-x)}Co_x$, where x has a value in the range of 0 to 1, x is greater than zero for at least one of the groups, and the value of x for any one of the groups differs from the value of x for any other one of the groups, the elevated pressure and temperature sufficient to consolidate the particles into a fully densified body having grains of the tetragonal crystal phase $RE_2(Fe_{(1-x)}Co_x)_{14}B_1$ where the grains have at least three different values of x.

14. A process according to claim 13 wherein the value of x for the first group is about zero and the value of x for the second group is in the range of greater than 0.2 to about 0.6.

15. A process according to claim 13 wherein before intermingling, the groups of particles are each prepared from a respective alloy precursor by heating the alloy precursor to a molten condition and then quenching the molten alloy in a non-oxidizing environment at a rate sufficient to form ribbons that are amorphous or of very fine crystal grained micro-structures, and then comminuting the ribbons to form the particles each having a maximum cross-dimension less than that of the ribbons.

16. A process according to claim 15 wherein the maximum cross-dimension is in the range of about 20 to about 500 microns.

17. A process according to claim 13 further including hot working the densified body at a pressure applied in the same direction as the pressing and at an elevated temperature to produce the body having aligned fine crystal grains, anisotropic permanent magnetic properties and having a lesser rate of change of specific heat and/or thermal expansion with temperatures as compared to such rate of change for a similarly densified, hot-worked anisotropic body of any one of the first and second groups of the particles.

18. The process according to claim 1 wherein each of the groups has an amount of rare earth metal which constitutes 30 to 31 weight percent of the composition corresponding to greater than 13 atomic percent and less than 15 atomic percent of the composition.

19. The process according to claim 7 wherein each of the groups has an amount of rare earth metal which constitutes 30 to 31 weight percent of the composition corresponding to greater than 13 atomic percent and less than 15 atomic percent of the composition.

20. The process according to claim 13 wherein each of the groups has an amount of rare earth metal which constitutes 30 to 31 weight percent of the composition corresponding to greater than 13 atomic percent and less than 15 atomic percent of the composition.

* * * * *